US005356004A

United States Patent [19]

Weinreb

[11] Patent Number: 5,356,004

[45] Date of Patent: Oct. 18, 1994

[54] CAMERA BAG DIVIDER SYSTEM

[76] Inventor: Robert Weinreb, 510 Broadway, New York, N.Y. 10012

[21] Appl. No.: 119,886

[22] Filed: Sep. 10, 1993

Related U.S. Application Data

[63] Continuation of Ser. No. 882,431, May 13, 1992, abandoned.

[51] Int. Cl.[5] ..... B65D 85/38

[52] U.S. Cl. ..... 206/316.2; 150/113; 190/110; 220/530

[58] Field of Search ..... 206/316.1, 316.2, 316.3, 206/523, 587, 593; 150/116, 112, 113; 190/109, 110; 220/530, 531

[56] References Cited

U.S. PATENT DOCUMENTS

| | | | |
|---|---|---|---|
| 1,370,525 | 3/1921 | Eisenkraft | 206/587 X |
| 2,314,491 | 3/1943 | Greenberg | 206/587 |
| 2,661,824 | 12/1953 | Nelson, Jr. | 190/109 |
| 4,210,186 | 7/1980 | Belenson | 206/316.2 |
| 4,212,377 | 7/1980 | Weinreb | 206/316.1 X |
| 4,260,004 | 4/1981 | Domke | 206/316.2 X |
| 4,403,638 | 9/1983 | Baum | 206/316.2 |
| 4,506,769 | 3/1985 | Franco et al. | 190/110 X |
| 4,610,286 | 9/1986 | Cyr | 190/110 X |
| 4,708,248 | 11/1987 | Davis | 206/549 |
| 4,765,476 | 8/1988 | Lee | 206/545 X |
| 4,842,032 | 6/1989 | Mastronardo | 206/316.2 X |
| 5,117,952 | 6/1992 | Suh | 206/316.2 X |

FOREIGN PATENT DOCUMENTS

| | | | |
|---|---|---|---|
| 0936431 | 12/1955 | Fed. Rep. of Germany | 206/316.2 |
| 1364559 | 1/1988 | U.S.S.R. | 220/531 |

*Primary Examiner*—Paul T. Sewell
*Assistant Examiner*—Ted Kavanaugh
*Attorney, Agent, or Firm*—Rosenman & Colin

[57] ABSTRACT

In a carrying case for cameras, lenses, accessories, or other articles a system of dividers which divide the case into multiple and variable compartments and which further are constructed to automatically open, to allow access to lower compartments, and to flex closed, to support a lens or other article in upper compartments. In the preferred embodiment the flex dividers are constructed with at least one vertical lower section joined to at least one upper section by memory flex means. The memory flex means tends to hold the upper section in an open or more vertical position when there is no load on the upper section, or to return the upper section toward the more vertical position when a load, holding the upper section in a closed or more horizontal position, is removed.

16 Claims, 9 Drawing Sheets

28
26
25
22
24
30U
25
36
38
38
36
38
30L
30
38
30
12E
20
20
12C
12B
12A
18

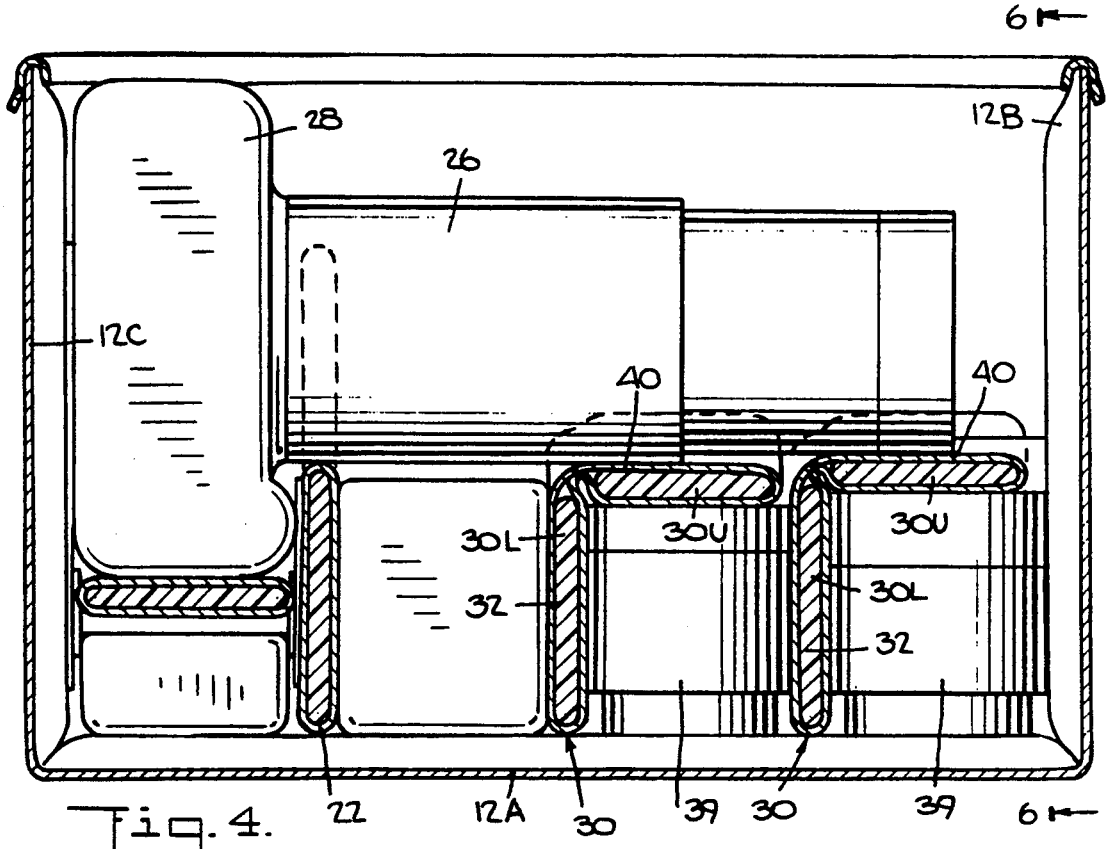
Fig. 4.
Fig. 5.
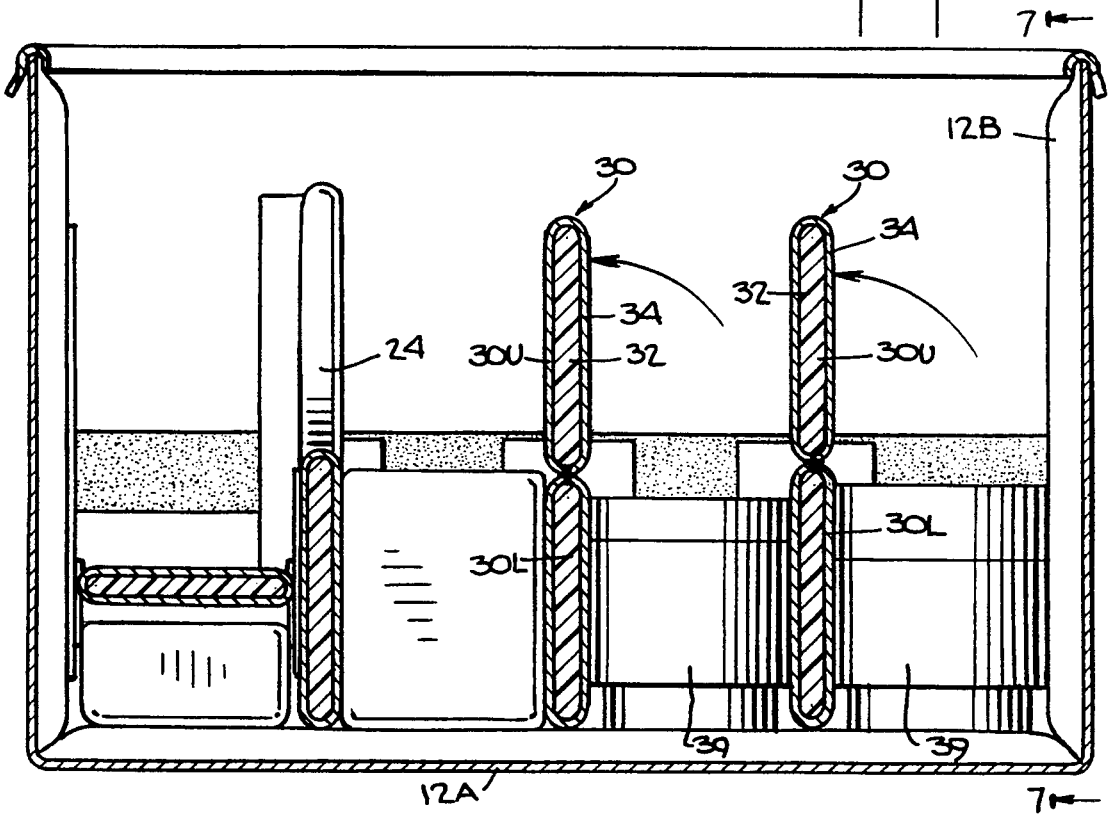

26
133
130U
130U
133
120
120
138
138
138
130
22
22
130L
20

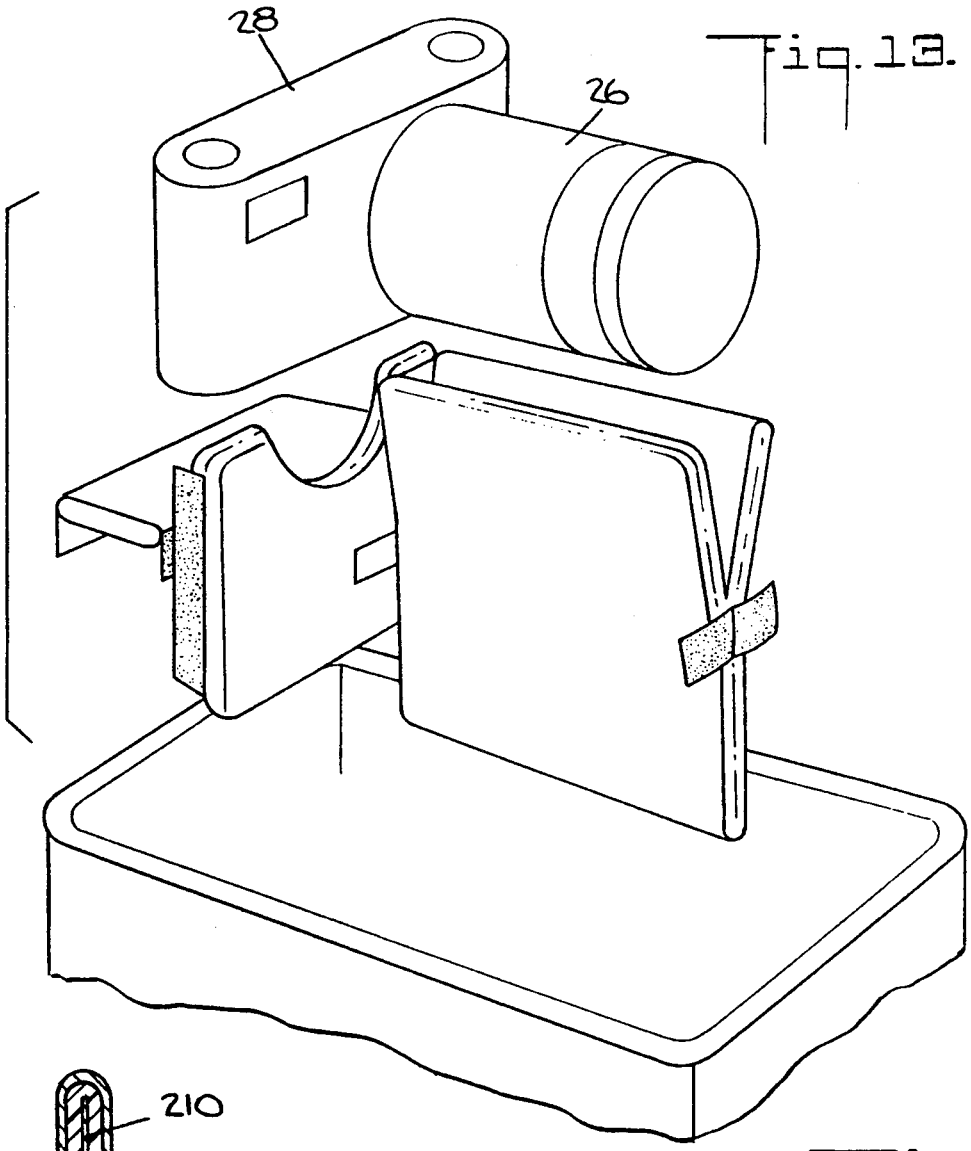
Fig. 13.
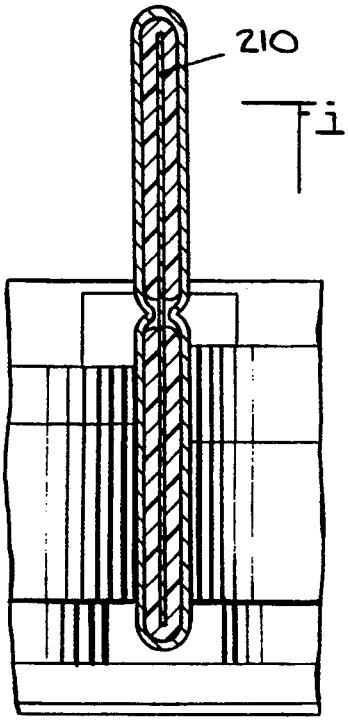
Fig. 14.
Fig. 15.
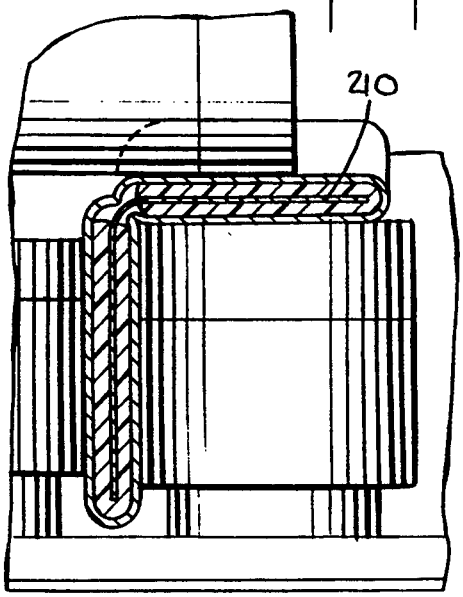

CAMERA BAG DIVIDER SYSTEM

This application is a continuation of U.S. application Ser. No. 07/882,431, filed May 13, 1992, now abandoned.

BACKGROUND OF THE INVENTION

Camera bags are common and range from simple cases supplied by camera manufacturers to correspond to a particular model of camera, to bags with multiple compartments adapted to take varying sizes of cameras, lenses, film, filters and other accessories useful to professional and serious amateur photographers. Multiple compartments are used to organize these materials and dividers which form the compartments, in properly constructed bags, are cushioned to protect the separated cameras, lenses and accessories.

Because selection of particular cameras, lenses and accessories is highly individualized, not only from user to user but also from assignment to assignment, sophisticated bags are provided with movable dividers to customize compartment sizes and locations. Illustrative is the bag disclosed in the present applicant's U.S. Pat. No. 4,212,377, issued Jul. 15, 1980.

Professional photographers working outside a portrait studio require fast, convenient and sequential access to the contents of their bags. For example, the first item to which quick access is needed is a camera with attached lens, next would be other lenses for fast lens changing, next might be various filters, films, backs, viewfinders. An appropriate loading arrangement in the bag would accordingly have the camera and attached lens on top and the various accessories in individual compartments below. In prior art such as is shown in U.S. pat. No. 4,610,286, issued Sept. 9, 1986, the solution to quick access to the lower compartments, when the camera with lens is removed, is to have the lower compartments open on top. The difficulty with such an approach is that when the camera and lens are in the bag and the bag is closed, there is nothing to prevent items in the bottom compartments from hitting the lens when the bag is turned on its side or upside down.

Another prior art construction, applicant's own, uses a vertical divider with an flap integrally hinged thereto. The flap portion, which is flat, rests horizontally over a lower compartment to protect the items therein, and is manually raised for access to the compartment.

SUMMARY OF THE INVENTION

The present invention accordingly provides an improved camera bag having an upper compartment adapted to receive a horizontal long lens with camera attached, multiple lower compartments defined in part by cushioned movable vertical dividers, and self-opening divider means between the upper and lower compartments to provide rapid and easy access to the lower compartments.

The present invention also provides self-opening divider means which combine vertical lower divider sections and movable upper divider sections, the sections being joined by memory flex joint means to urge the movable divider sections from substantially horizontal positions when supporting a load to more vertical positions when the load is removed.

In the preferred embodiment of the invention, the self-opening divider means comprises at least one flexible or semi-rigid inner foam cushion, covered with a wear- and dirt-resistant fabric, which are sewn along a configuration line which defines the flex joint. The configuration line is the line along which the foam bends, apparently due to the line being relatively weaker than other sections of the foam. The natural resistance of the foam to bending is, in effect, a memory to return the bent foam to its original straight shape. The configuration line for a typical round barrel lens would be curved, thereby forcing the bent section to assume a curved semi-cylindrical shape conforming to the round lens barrel. A curved-configuration line is not a natural straight bend line and the stress of distorting the foam to assume a curved bend provides significant additional force or memory to return the bent divider to its original upright unbent condition.

DESCRIPTION OF THE DRAWING

FIG. 4 is a cross-sectional view taken across line 4—4 of FIG. 1.

FIG. 5 is a view similar to that of FIG. 4 with the camera, lens and accessories removed, showing the automatic return of the upper divider sections to an upright position, opening the lower compartments to access.

FIG. 13 is a exploded view of a dimensionally different modified embodiment of the invention.

FIG. 14 is a cross-sectional view of a further modified embodiment of the divider of the invention which is generally similar to the preferred embodiment but with a stiffener added.

FIG. 15 is a view of the embodiment shown in FIG. 14, bent under load.

DESCRIPTION OF A PREFERRED EMBODIMENT

Figure 1:
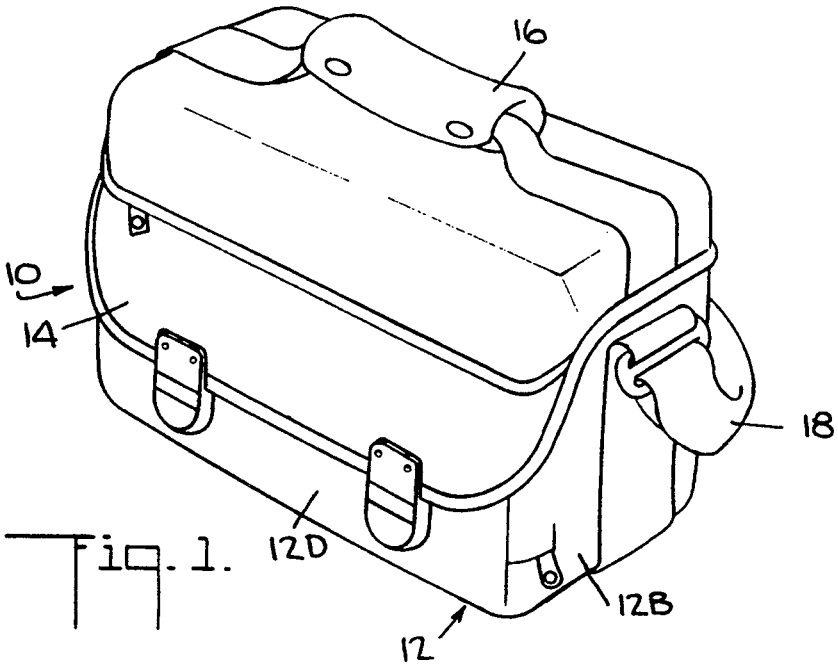
FIG. 1 is a perspective view of the camera bag divider system of the invention.

With reference to the drawing, camera bag divider system 10 of the invention comprises a carrier portion 12 having a bottom 12A, opposed side wall members 12B and 12C, a front wall or panel member 12D and a back wall or panel member 12E, the sides, front and back being padded and upstanding from the bottom and being joined to form an open-topped container, and a flap cover 14 therefor. Bag or carrier portion 12 has a normal upright position, whether being carried by handle 16 or strap 18 or standing on a horizontal surface, and it will be understood that orientation and direction as used herein are relative to the normal position and are not absolute.

Extending around the inner periphery of carrier portion 12 are two narrow horizontal bands (or one wide horizontal band) of a Velcro TM -type hook or eye fastener member 20. In the preferred embodiment there are at least two such bands, each running continuously around the entire inner periphery.

A plurality of vertically disposed dividers of different types are used to compartmentalize carrier portion 12. A typical divider of the type used in the prior art is rigid divider 22 which may extend almost full height of carrier 12 and which may have a cutout 24 to receive a lens 26 attached to a camera 28. Rigid divider 22 extends the full distance from front panel 12D to-back panel 12E and has Velcro TM -type fastener strips 25 along each vertical edge to complement and join Velcro TM -type fastener members 20 in adjustably affixed position in carrier 12.

Figure 2:
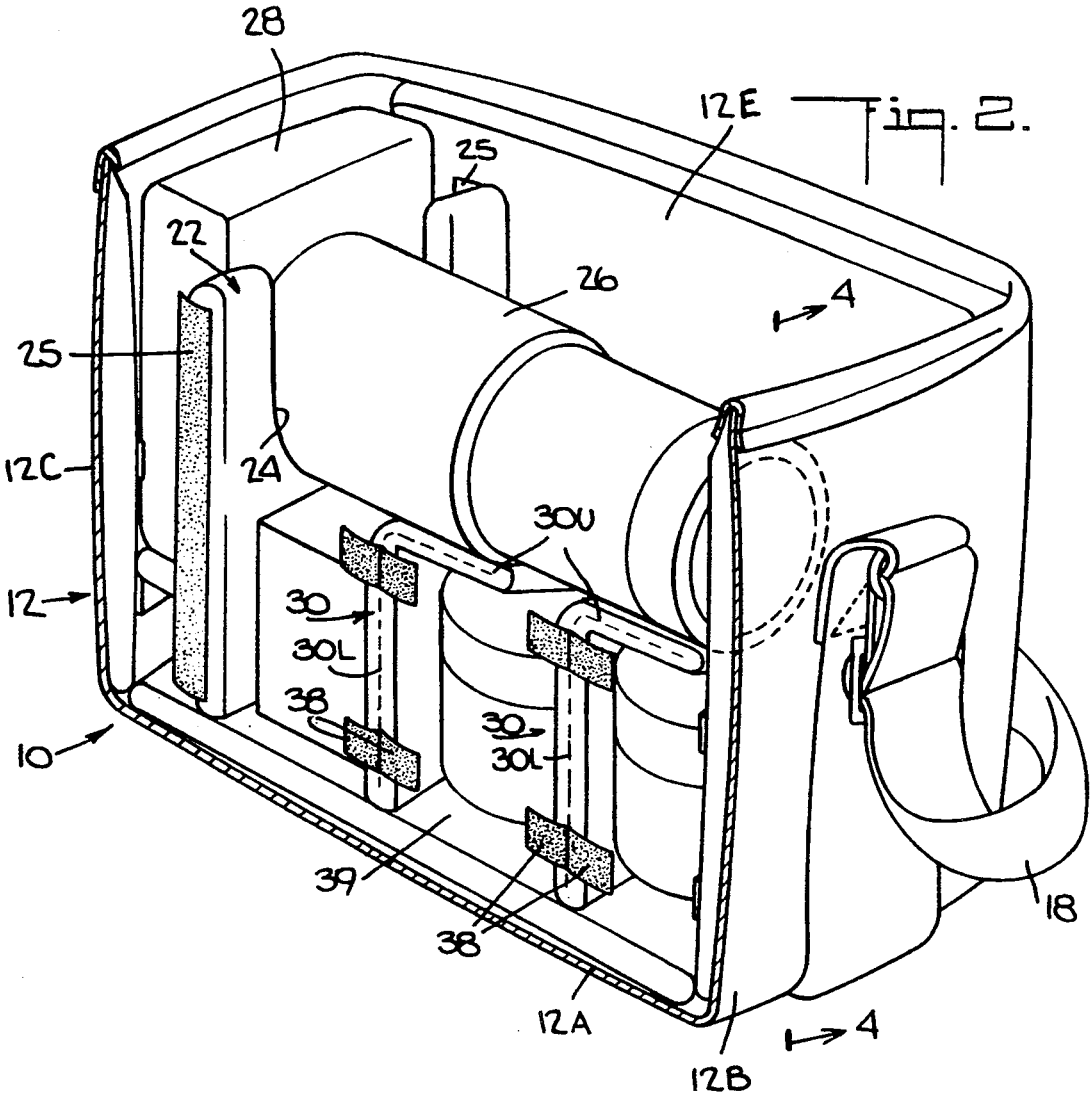
FIG. 2 is a perspective view, partly in cross-section of the camera bag divider system of the invention, showing the bag loaded in a typical manner with a long lens in the upper compartment, resting on bent curved dividers, and miscellaneous material in the lower compartments.
Figure 3:
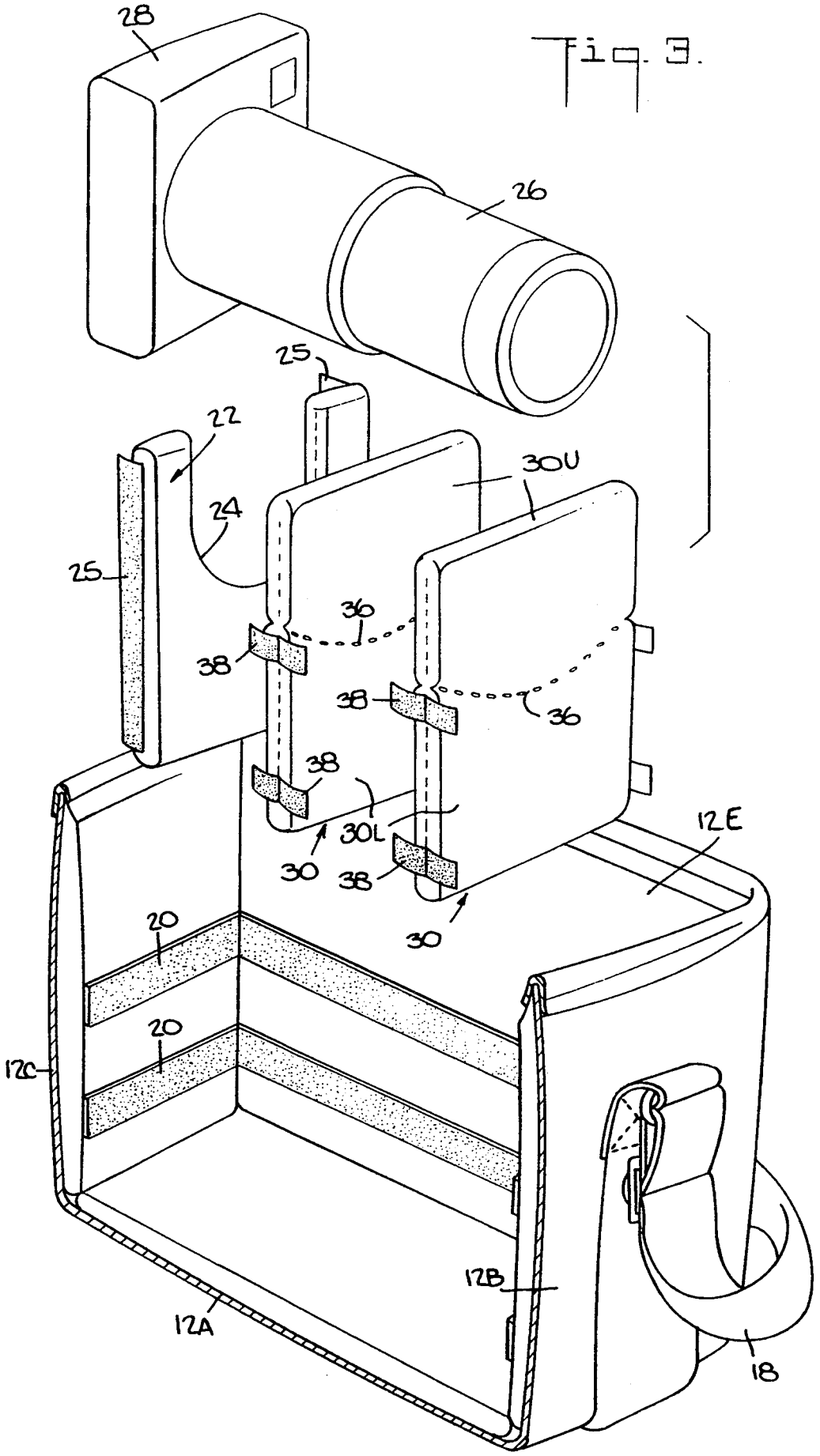
FIG. 3 is a exploded view of the camera bag, partly in cross-section, and the dividers of the preferred embodiment of the invention, with a typical camera and mounted lens.
Figure 6:
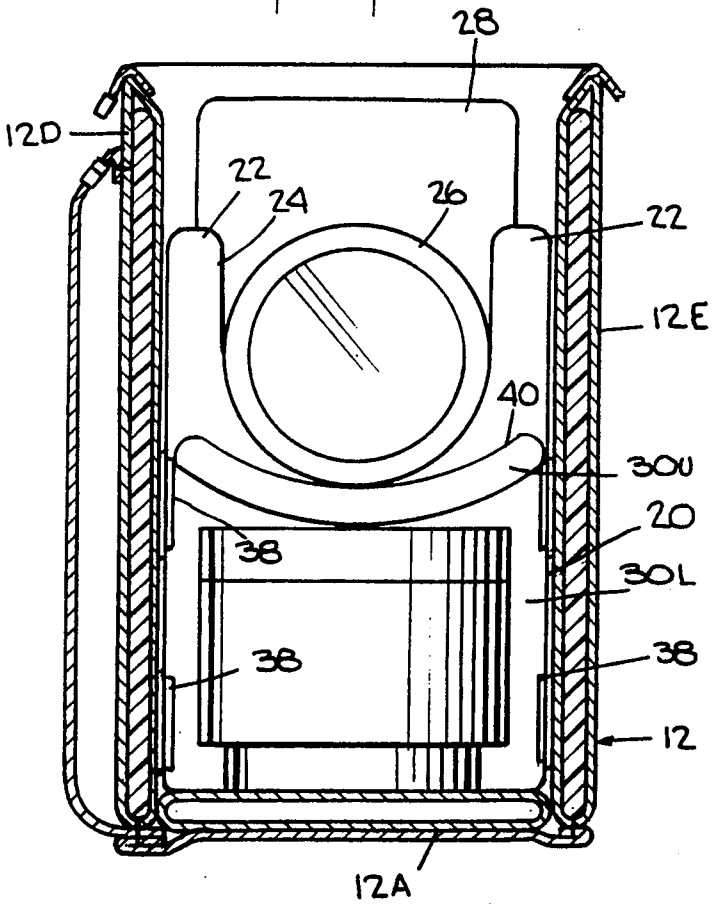
FIG. 6 is a cross-sectional view taken across line 6—6 of FIG. 4.

Self-opening divider means 30 of the preferred embodiment of the invention comprises at least one semi-rigid inner foam cushion or core 32, covered with a wear- and dirt-resistant fabric 34, which are sewn along a configuration line 36 which defines a flex joint. Semi-rigid as used herein means having the characteristics of stiffness, flexibility and memory to return to an unflexed or normal condition. The configuration line 36 is the line along which the foam flexes or bends, as shown in FIGS. 2 and 4, apparently due to the sewn line being relatively weaker than other sections of the foam. The natural resistance of the foam to bending is, in effect, a memory to return the bent foam to its original straight shape as shown in FIGS. 3 and 5. The configuration line for a typical round barrel lens 26 would be curved, thereby forcing the bent section to assume a curved semi-cylindrical shape as shown in FIG. 6, generally conforming to round lens barrel 26. A curved configuration line is not a natural straight bend line and the stress of distorting the foam to assume a curved bend provides significant additional force or memory to return the bent divider to its original upright unbent condition.

In particular, each self-opening divider means 30 is divided by configuration line 36 into an upper divider section 30U and a lower divider section 30L. Lower divider section 30L is provided With Velcro TM -type fastener tabs 38 along each vertical edge to complement and join Velcro TM -type fastener members 20 in adjustably fixed vertical position in carrier 12. The result is that each self-opening divider means 30, alone or in conjunction with other divider means 30 and/or rigid divider 22, divides carrier 12 into compartments 39. In their natural, relaxed or memory positions, the upper divider portions 30U are also vertical, or at least more substantially vertical than when they are under load, and each compartment 39 is open for access from the top, as shown in FIG. 3. Under applied force, such as manually or by weight of lens 26, upper divider sections 30U bend or flex along configuration lines 36 until they are in substantially horizontal positions, as shown in FIGS. 2, 5 and 6, thereby closing off those compartments 39 which are therebelow. When the applied force is removed from upper divider sections 30U, such as by taking lens 26 out of camera bag 10, upper divider sections 30U return to their substantially upright or vertical positions, thereby automatically opening closed compartments 39 to ready access.

Figure 7:
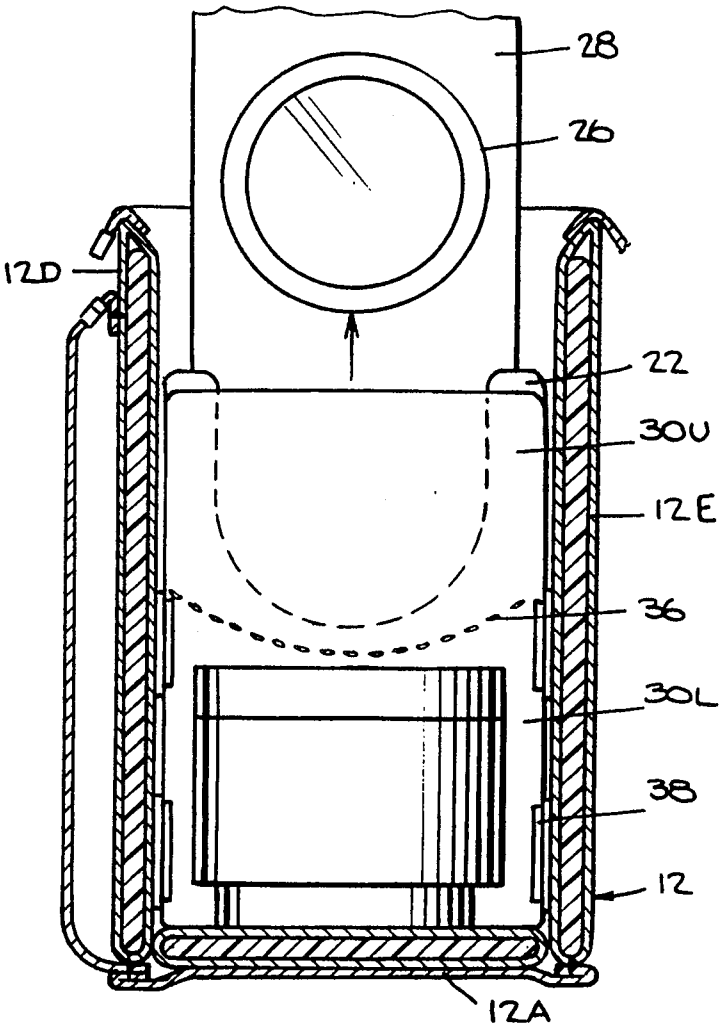
FIG. 7 is a cross-sectional view taken across line 7—7 of FIG. 5.

A curved configuration line 36 will cause upper divider section 30U to bend into a correspondingly curved or semi-cylindrical configuration when flexed under load to a substantially horizontal position in order to more closely conform to and cup around the shape of lens barrel 26. Additionally, configuration line 36 is located slightly below the height of cutout 24, as shown in FIG. 7, so that the top surface 40 of upper divider section 30U, taking its thickness into account, substantially aligns with cutout 24 to support lens 26, as shown in FIGS. 4 and 6.

As noted, configuration line 36 is a weakened flex line formed by sewing, but alternative means of providing a weakened flex line may be used, such as by heat bonding a line in the foam core 32 or in combination with fabric cover 34.

Figure 8:
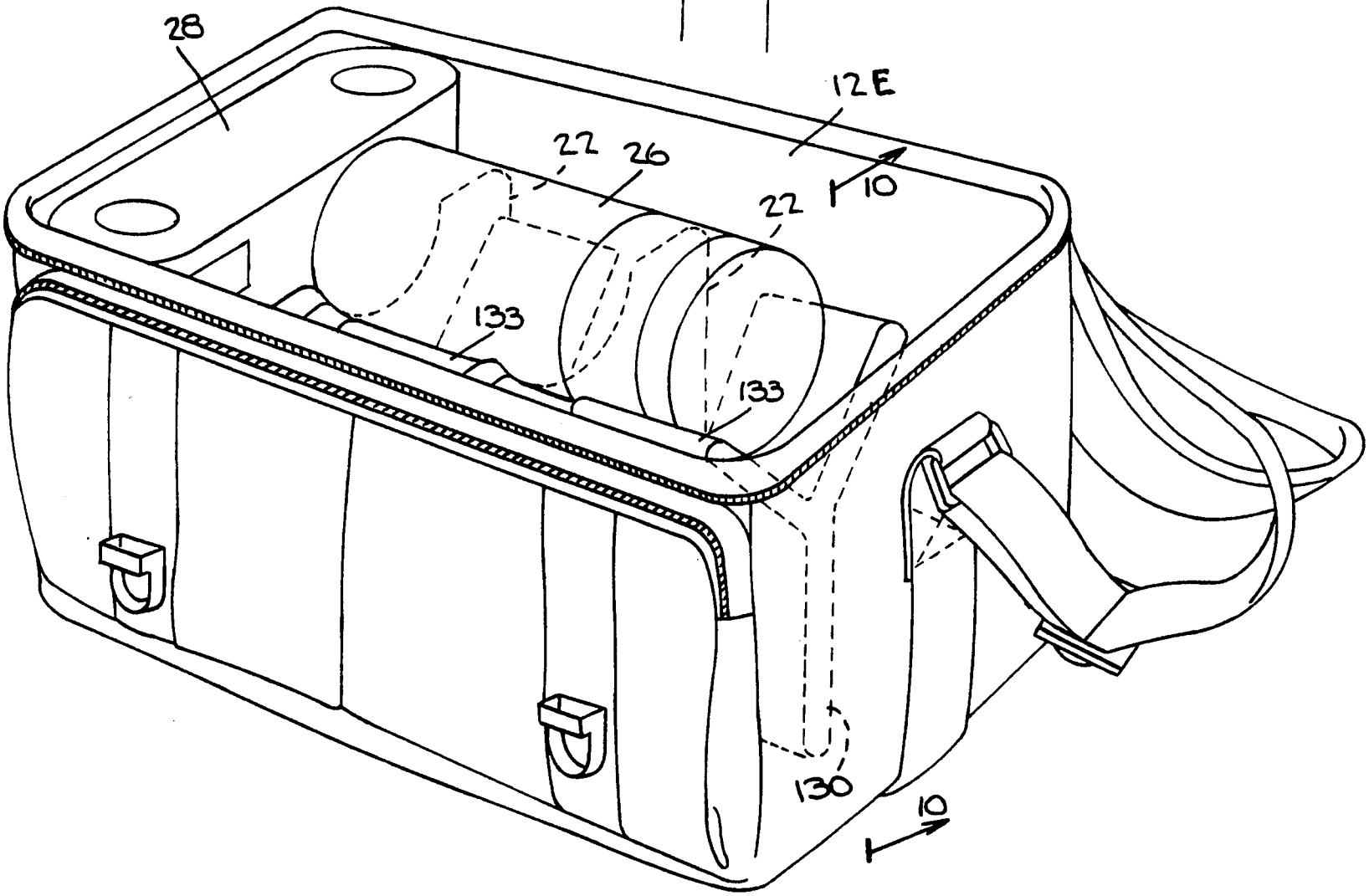
FIG. 8 is a perspective view of the camera bag divider system of the invention with the cover flap open.
Figure 9:
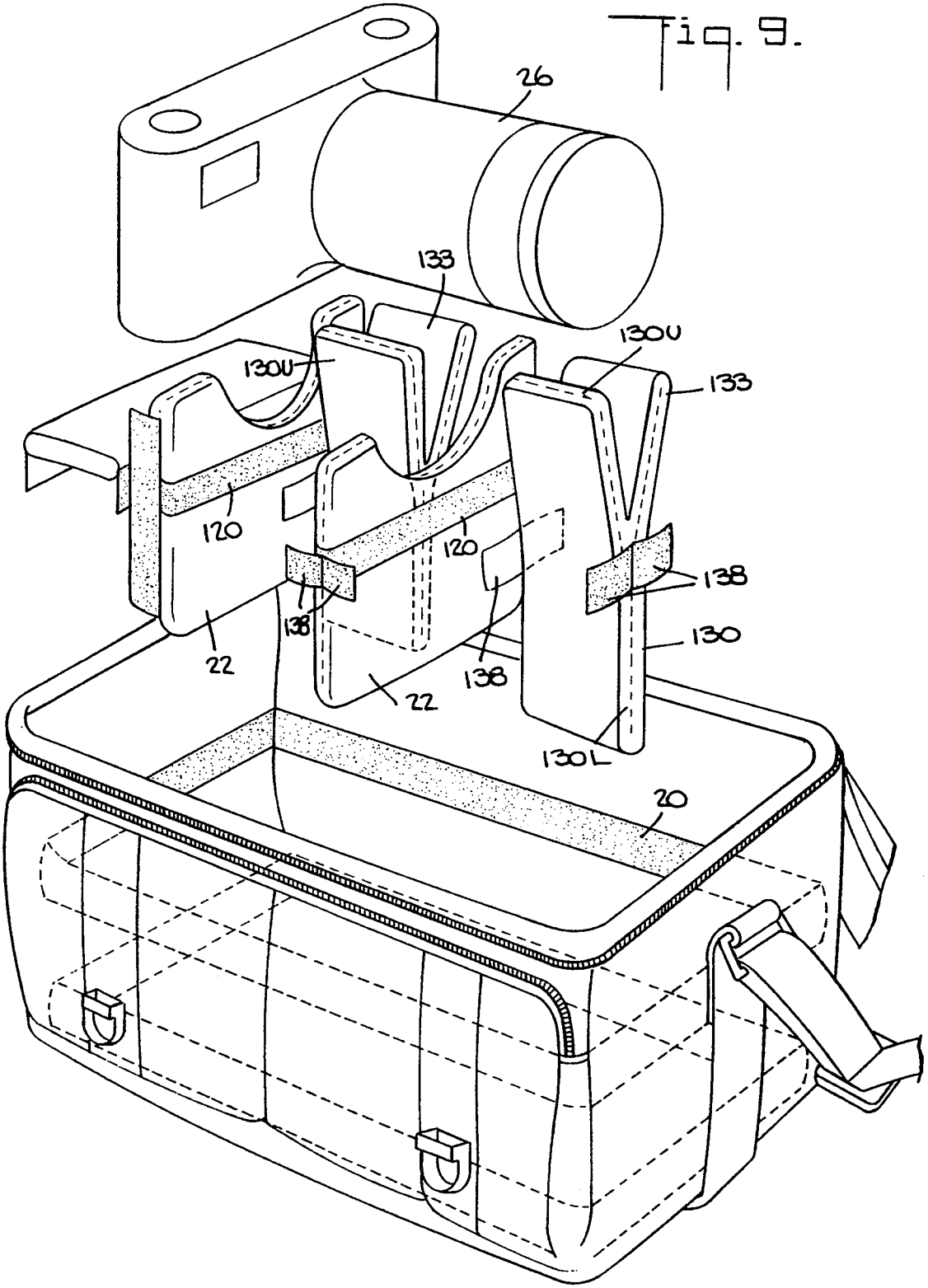
FIG. 9 is a exploded view of the camera bag, partly in cross-section, and the dividers of a modified embodiment of the invention, with a typical camera and mounted lens.
Figure 10:
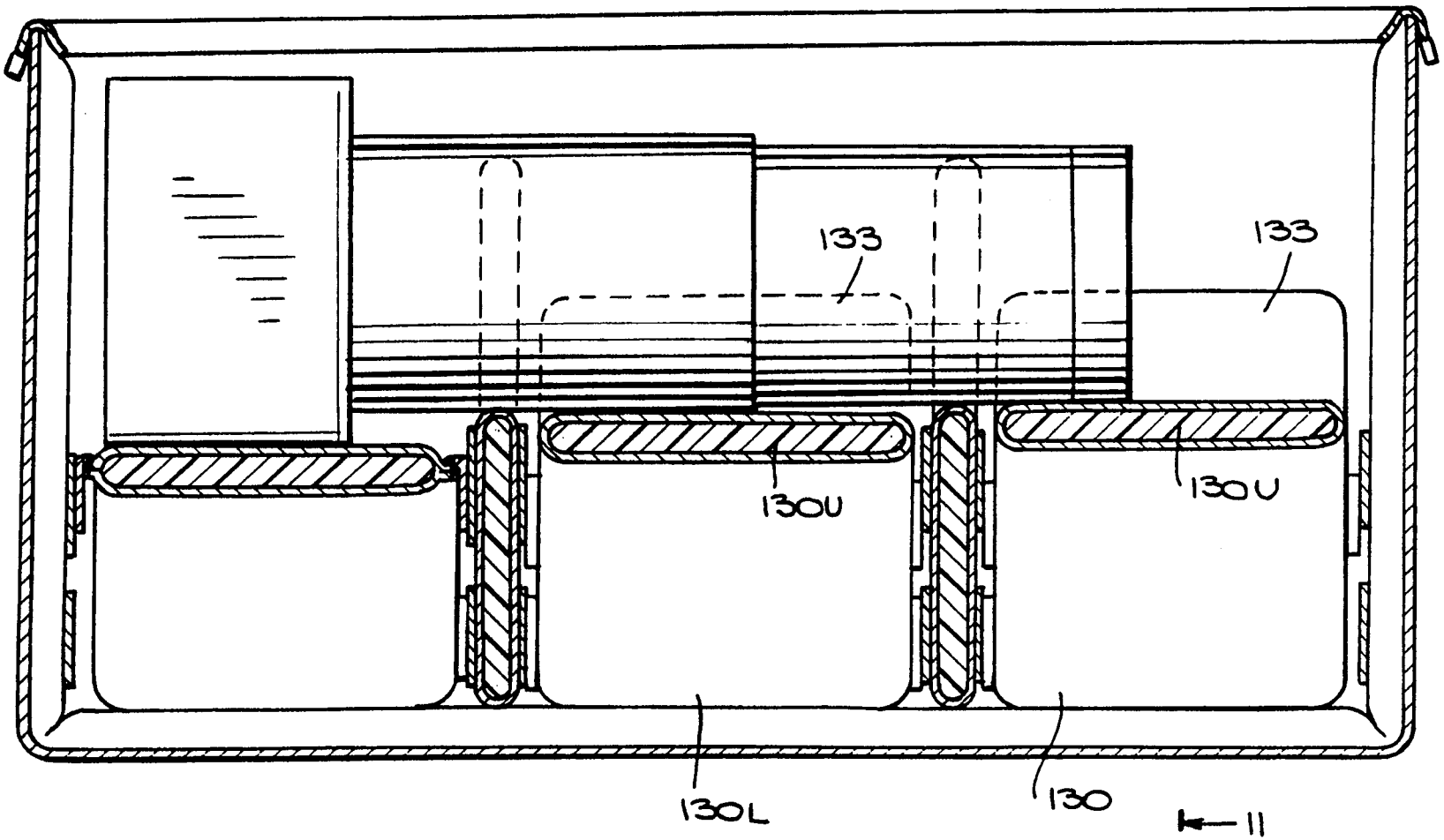
FIG. 10 is a cross-sectional view taken across line 10—10 of FIG. 8.
Figure 12:
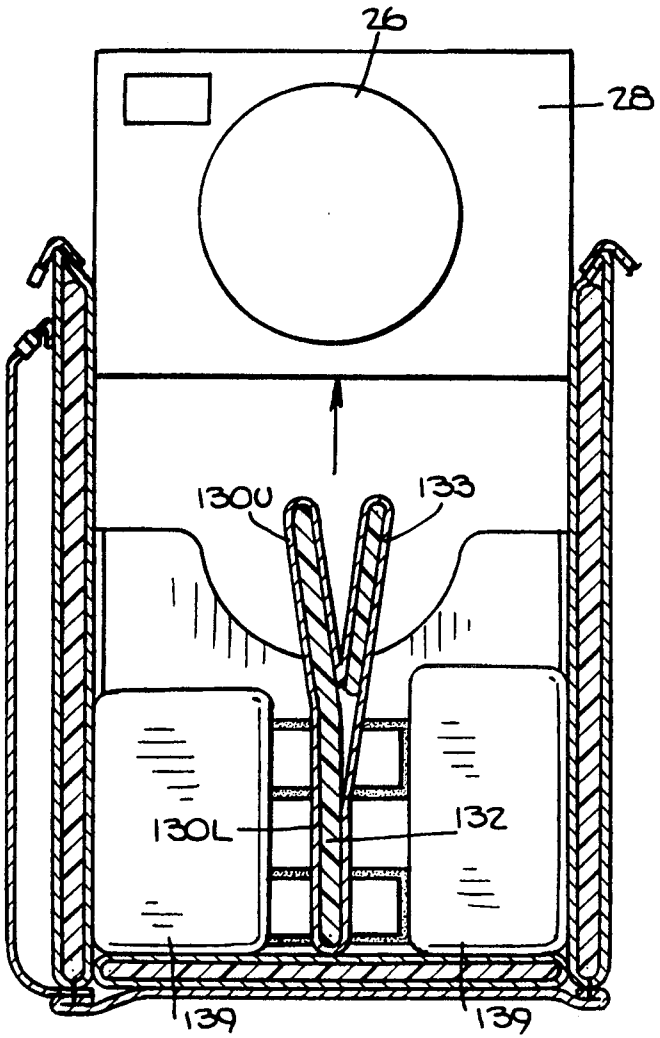
FIG. 12 is a view similar to that of FIG. 11 with the camera, lens and accessories removed, showing the automatic return of the upper divider sections to an upright position, opening the lower compartments to access.
Figure 11:
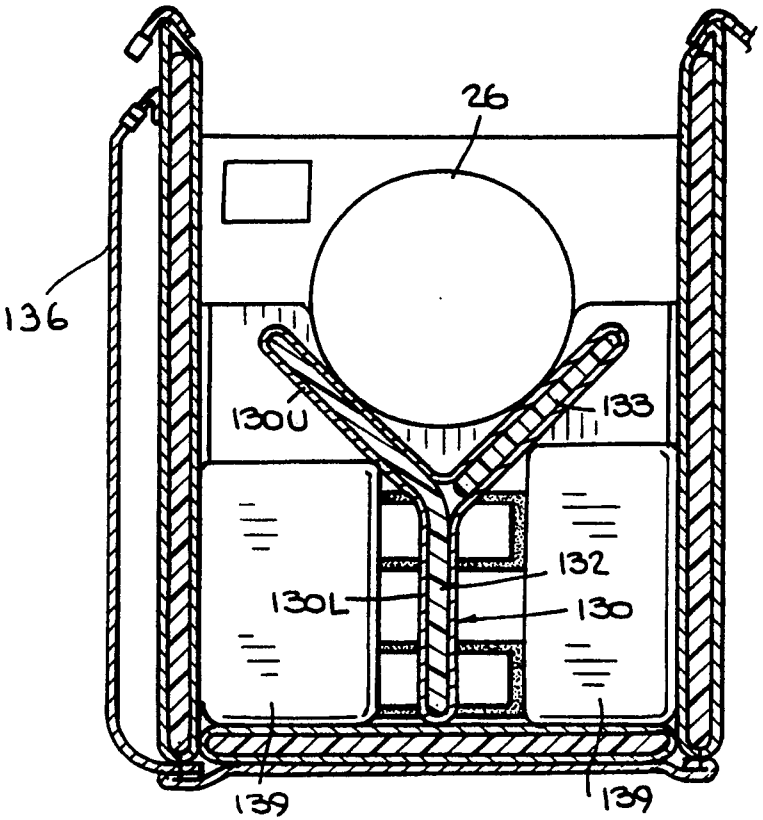
FIG. 11 is a cross-sectional view taken across line 11—11 of FIG. 10.

In an alternate embodiment, as shown in FIGS. 8–13, self-opening divider means 130 comprises a first full length foam core 132 with a second shorter foam core 133 joined thereto near or along a substantially horizontal flex joint 136 to-form a Y-shape. The portion of full length foam core 132 which is below flex joint 136 is lower divider section 130L which is adjustably affixed as will shortly be described. The portion of foam core 132 which is above flex joint 136 is upper divider section 130U. In the natural, unloaded condition, upper divider section 130U and shorter foam core 133 are more substantially vertical, as shown in FIGS. 9, 12 and 13, while when under load as from lens 26, upper divider section 130U and short section 133 are caused to diverge to support the lens, as shown in FIGS. 8, 10 and 11.

It will be noted that in the preferred embodiment shown in FIGS. 1–7, each self-opening divider means 30 is parallel to rigid divider 22, that is, each extends from front panel 12D to back panel 12E. In the first modified embodiment shown in FIGS. 8–13, however, each self-opening divider means 130 is perpendicular to rigid divider 22 and thereby divides carrier 12 into separate front and back lower compartments 139. The latter is particularly advantageous with a camera bag 10 which has a large front 12D to back 12E dimension.

In order to adjustably locate and align self-opening divider means 130, multiple rigid dividers 22, each with a Velcro TM horizontal fastener band 120, are located in the normal front 12D to back 12E orientation by attachment to Velcro TM fastener member 20. The edges of self-opening divider means 130 are provided with Velcro TM -type fastener tabs 138 along each vertical edge to complement and be adjustably affixed to Velcro TM -type fastener bands 120.

It will be appreciated that other embodiments and modifications may be made within the teachings hereof. For example, as shown in FIGS. 14 and 15, a flexible stiffener 210 may be used in self-opening divider means 30 to provide additional self-opening force, or to provide more support for a load such as lens 26, or to provide a particular shape to upper divider section 30U or 130U to better cradle or cup the load. Also, in the event that self-opening divider means are not needed, the type or thickness of foam core 32 or 132 may be such as to reduce the memory force to below that which is needed to overcome the weight of upper divider section 30U or 130U without load: the flap would then stay closed when the load is removed. In such circumstances, the divider is manually openable but, when closed, has the desired curved configuration.

What is claimed is:

1. A case for photographic accessories, comprising:

(a) a base wall;

(b) a plurality of upstanding walls extending away from, and bounding an interior space with, the base wall;

(c) a lid wall mounted on the case for movement between open and closed positions; and (d) divider means for compartmentalizing the interior space, including a flexible divider having (i) a lower section mounted on, and bounding a lower compartment for receiving a first accessory with the base wall, and (ii) an upper resilient section connected to, and movable relative to, the lower section between a covering position in which the upper section at least partially covers the lower compartment when a second accessory is positioned in the case on the upper section, and an access position in which the upper section at least partially uncovers the lower compartment when the second accessory is removed from the case, said upper section being at least partly constituted of a resilient material having an inherent resilience and constantly biasing itself due to said inherent resilience toward the access position, and wherein said upper resilient section, moves toward the access position, with removal of said second accessory, said upper resilient section being configured and positioned such that it does not interfere with the lid wall, in the closed position, whereby said case is closeably utilizable, with the upper resilient section remaining in said access position.

2. The case according to claim 1, wherein the base wall is generally planar, and wherein the upstanding walls include a first pair of generally planar end walls spaced apart of each other along a longitudinal direction, and a second pair of generally planar side walls spaced apart of each other along a transverse direction normal to said longitudinal direction.

3. The case according to claim 1, wherein each wall is padded.

4. The case according to claim 1, wherein the flexible divider includes a core and a cover enclosing the core.

5. The case according to claim 4, wherein the core is constituted to foam, and wherein the cover is constituted of fabric.

6. The case according to claim 1, wherein the base wall lies in a generally horizontal plane, and wherein the flexible divider lies in a generally vertical plane, and wherein the upper and lower sections are coplanar in the vertical plane in the access position.

7. The case according to claim 1, wherein the base wall lies in a generally horizontal plane, and wherein the lower section lies in a generally vertical plane, and wherein the upper section lies in an inclined plane relative to the lower section; and further comprising another upper resilient section connected to, and movable relative to, the lower section, said other upper section lying in an inclined plane relative to the lower section, and wherein both upper sections bound therebetween a predetermined angle.

8. The case according to claim 7, wherein both upper sections are mounted for movement toward each other during movement toward the access portion to decrease said predetermined angle.

9. The case according to claim 7, wherein one of the upper sections and the lower section are constituted of a single piece of foam, and wherein the other upper section is constituted of another piece of foam, and wherein both foam pieces are enclosed in a fabric cover.

10. The case according to claim 1 and further comprising a stiffener member located within the flexible divider.

11. The case according to claim 1 and further comprising another flexible divider mounted within the case and spaced apart from the first-mentioned flexible divider.

12. The case according to claim 1 and further comprising means for adjustably mounting the flexible divider within the case.

13. The case according to claim 12, wherein the mounting means includes a fastener strip extending around the upstanding walls within the case, and a complementary fastener attached to the lower section of the flexible divider.

14. The case according to claim 1 and further comprising a rigid divider mounted within the case and spaced from the flexible divider, and wherein the rigid divider has means for supporting a camera having an elongated cylindrical lens above the lower compartment, and wherein the upper resilient section additionally supports the lens in the covering position.

15. A case for photographic accessories, comprising:

(a) a base wall lying in a generally horizontal plane;

(b) a plurality of upstanding walls extending away from, and bounding an interior space with, the base wall; and (c) divider means for compartmentalizing the interior space, including a flexible divider lying in a generally vertical plane and having (i) a lower section mounted on, and bounding a lower compartment for receiving a first accessory with, the base wall, (ii) an upper resilient section having a dished shape and connected to, and movable relative to, the lower section between a covering position in which the upper section at least partially covers the lower compartment when a second accessory is positioned in the case on the upper section, and an access position in which the upper section at least partially uncovers the lower compartment when the second accessory is removed from the case, said upper section being at least partly constituted of a resilient material having an inherent resilience and constantly biasing itself due to said inherent resilience toward the access position, (iii) a curved seam dividing the upper and lower sections, and (iv) said upper and lower sections being co-planar in the vertical plane in the access position, and said upper section lying generally parallel to the base wall in the covering position.

16. A case for photographic accessories, comprising:

(a) a base wall;

(b) a plurality of upstanding walls extending away from, and bounding an interior space with, the base wall; and (c) divider means for compartmentalizing the interior space, including a flexible divider having (i) a lower section mounted on, and bounding a lower compartment for receiving a first accessory with, the base wall, (ii) an upper resilient section connected to, and movable relative to, the lower section between a covering position in which the upper section at least partially covers the lower compartment when a second accessory is positioned in the case on the upper section, and an access position in which the upper section at least partially uncovers the lower compartment when the second accessory is removed from the case, said upper section being at least partly constituted of a resilient material having an inherent resilience and constantly biasing itself due to said inherent resilience toward the access position, (iii) a core, (iv) a cover enclosing the core, and (v) an upwardly concave seam sewn through the cover and the core, said upper section bending along the seam.

* * * * *